US007408524B2

(12) United States Patent
Ogino

(10) Patent No.: US 7,408,524 B2
(45) Date of Patent: Aug. 5, 2008

(54) LOOP ANTENNA

(75) Inventor: Kazushige Ogino, Kobe (JP)

(73) Assignee: Fujitsu Ten Limited, Kobe-shi (JP)

( * ) Notice: Subject to any disclaimer, the term of this patent is extended or adjusted under 35 U.S.C. 154(b) by 55 days.

(21) Appl. No.: 11/391,756

(22) Filed: Mar. 28, 2006

(65) Prior Publication Data

US 2006/0220977 A1 Oct. 5, 2006

(30) Foreign Application Priority Data

Mar. 29, 2005 (JP) ..... 2005-095516
Feb. 7, 2006 (JP) ..... 2006-029953

(51) Int. Cl.
*H01Q 7/00* (2006.01)
*H01Q 1/32* (2006.01)

(52) U.S. Cl. ..... 343/866; 343/713

(58) Field of Classification Search ..... 343/866, 343/702, 741, 700 MS, 855
See application file for complete search history.

(56) References Cited

U.S. PATENT DOCUMENTS 5,371,507 A * 12/1994 Kuroda et al. ..... 343/700 MS
5,557,293 A * 9/1996 McCoy et al. ..... 343/867
5,926,139 A * 7/1999 Korisch ..... 343/702
6,016,128 A * 1/2000 Imamura et al. ..... 343/741
6,236,368 B1 * 5/2001 Johson ..... 343/702
6,924,769 B2 8/2005 Ito et al.
7,215,293 B2 * 5/2007 Chen et al. ..... 343/741
7,253,773 B2 * 8/2007 Chiba et al. ..... 343/702

FOREIGN PATENT DOCUMENTS

| | | |
|---|---|---|
| JP | 9-148838 | 6/1997 |
| JP | 2000-269724 | 9/2000 |
| JP | 2002-135045 | 5/2002 |
| JP | 2003-198410 | 7/2003 |
| JP | 2004-88218 | 3/2004 |

OTHER PUBLICATIONS

Patent Abstract of Japan, Publication No. 09-148838, published Jun. 6, 1997, in the name of Ito, Sadao.
Patent Abstract of Japan, Publication No. 2000-269724, published Sep. 29, 2000, in the name of Sato, Sakiko.
Patent Abstract of Japan, Publication No. 2002-135045, published May 10, 2002, in the name of Ogino, Kazushige.
Computer generated English translation of Japan Publication 2002-135045, published May 10, 2002.
Patent Abstract of Japan, Publication No. 2003-198410, published Jul. 11, 2003, in the name of Ito, Hideo.
Patent Abstract of Japan, Publication No. 2004-088218, published Mar. 18, 2004, in the name of Wakabayashi, Toshio.

* cited by examiner

*Primary Examiner*—Huedung Mancuso
(74) *Attorney, Agent, or Firm*—Christie, Parker & Hale, LLP

(57) ABSTRACT

A loop antenna providing a reception performance equivalent to a patch antenna receiving a circularly polarized wave, simple in configuration, and kept low in cost, which forms a loop element and a parasitic element provided independently of this loop element on the same dielectric board to form an antenna element and sends or receives a circularly polarized wave by this antenna element, provides a metal plate parallel with or having a slight inclination with respect to the dielectric board, and sets this metal plate separated from the dielectric board by exactly a predetermined distance.

16 Claims, 16 Drawing Sheets

LOOP ANTENNA

CROSS-REFERENCE TO RELATED APPLICATION

This application claims priority from, and incorporates by reference the entire disclosures of, Japanese Patent Application (1) No. 2005-095516, filed on Mar. 29, 2005 and (2) No. 2006-029953, filed on Feb. 7, 2006.

BACKGROUND OF THE INVENTION

1. Field of the Invention

The present invention relates to a loop antenna, more particularly relates to a loop antenna able to obtain a reception performance of a circularly polarized wave equivalent to that of a patch antenna, by a simple configuration. The loop antenna of the present invention can be applied to an antenna system provided with an electronic apparatus connected with this antenna by a cable and to a vehicle mounting an antenna system able to obtain a reception performance of a circularly polarized wave equivalent to that of a patch antenna by installing this antenna system at a dielectric part of the vehicle.

2. Description of the Related Art

In the past, automobiles and other vehicles (moving bodies) have been equipped with antennas enabling the reception of radio waves even during movement. In general, the radio waves received by a vehicle have principally been the medium waves (MW) for AM radio and the very high frequency (VHF) or ultrahigh frequency (UHF) waves for FM radio or television.

However, in recent years, in addition to antennas receiving these radio waves, antennas for global positioning systems (GPS), antennas for receiving satellite waves of satellite digital broadcasts or their reradiated waves (gap filler waves), antennas for receiving waves for conversation over car phones, mobile phones, etc., and other antennas have become increasingly required for vehicles. Further, antennas for sending and receiving radio waves to and from parts of intelligent traffic systems (ITS) such as electronic toll collectors (automatic toll systems) for automatically collecting tolls on highways and toll roads and radio wave beacons of vehicle information communication systems (VICS) providing road traffic information have become necessary. Therefore, recent vehicles have had to mount antennas for receiving and sending a large number of types of radio waves (media).

Among the radio waves sent from and received by these moving bodies, the GPS waves, satellite digital broadcast waves, and electronic toll collector waves are a circularly polarized wave. Further, for conventional a circularly polarized wave antennas, patch antennas have usually been used. Among these patch antennas, ones comprised of ceramic or other dielectric boards on one surface of which planar ground conductors are laid and on the other surface of which radiating conductors are laid have often been employed. As this type of patch antenna, a low profile patch antenna for moving bodies used on the roofs of automobile and other moving bodies, that is, a low profile moving body use patch antennas, has been employed (for example, see Japanese Patent Publication (A) No. 2002-135045, FIG. 1 and FIG. 3).

However, the patch antenna disclosed in Japanese Patent Publication (A) No. 2002-135045 etc. is comprised of two types of dielectric boards superposed over each other and is formed with power parts passing through the boards, so there were the problems that the structure was complicated and the cost was high. As a result, the antenna system connecting a patch antenna disclosed in Japanese Patent Publication (A) No. 2002-135045 to an electronic apparatus by cables also became high in cost. Further, a vehicle mounting a patch antenna disclosed in Japanese Patent Publication (A) No. 2002-135045 etc. suffered from the problem of poor appearance due to the use of the patch antenna provided on the roof.

SUMMARY OF THE INVENTION

An object of the present invention is to provide a loop antenna providing a reception performance equivalent to a patch antenna receiving a circularly polarized wave, requiring use of only a single dielectric board, and able to be kept down in cost.

To achieve this object, the loop antenna of the present invention is a loop antenna having an antenna element comprised of a loop element and parasitic element provided independent of the loop element and transmitting or receiving a circularly polarized wave, wherein the antenna element is formed on a single surface, and a conductor surface parallel with or having a slight inclination from the surface is provided near the surface.

Such a loop antenna can be configured as follows:

1) The conductor surface is comprised of wire conductors arranged in a mesh.
2) The antenna element is formed on one surface of a dielectric board or at a certain layer of a member forming a dielectric board, while the conductor surface is formed on the other surface of this dielectric board or at another layer than that certain layer of the member forming the dielectric board. The dielectric board in this case may be made a dielectric member provided in a vehicle.
3) The antenna element and conductor surface may be provided on different dielectric boards. In this case, the conductor surface may be made a conductor forming part of the chassis of the vehicle, a conductor forming part of equipment provided in the vehicle, or a conductor attached to the vehicle. On the other hand, part of the member forming the conductor surface may be extended in the direction of the dielectric member forming the antenna element and this extended part used to support the dielectric member.
4) The conductor pattern of the antenna element is formed on a dielectric board, while the same board is formed with a circuit connecting to the loop element of the antenna element. In this case, the circuit may also be arranged inside the loop of the loop element. Further, outside of the circuit, two loop elements with different loop diameters may be formed doubly without overlap.
5) A power part formed on a surface separate from the surface where the antenna element is provided, a conducting means connecting the antenna element and the power part, a mesh ground pattern formed on the surface of the dielectric where the power part is provided, and a driven circuit part provided to contact the power part are provided. In this case, the dielectric may be a dielectric member forming part of a vehicle.

Further, the loop antenna of the present invention may be applied to an antenna system provided with an electronic apparatus connected to the loop antenna by a cable. This antenna system is an antenna system comprised of a loop antenna having an antenna element comprised of a loop element and a parasitic element provided independently of the loop element and sending or receiving a circularly polarized wave, an electronic apparatus processing a signal sent or received by the loop antenna, and a cable connecting the loop antenna and the electronic apparatus, wherein the antenna element is formed on one surface and a conductor surface parallel to that surface or having a slight inclination is provided near that surface.

Further, the loop antenna of the present invention can be applied to a vehicle mounting an antenna system providing a loop antenna at a dielectric part of the vehicle so as to obtain a reception performance of a circularly polarized wave equivalent to that of a patch antenna. That is, the present invention provides a vehicle equipped with an antenna system comprised of a loop antenna having an antenna element comprised of a loop element and a parasitic element provided independently of the loop element and sending and receiving a circularly polarized wave, an electronic apparatus for processing a signal sent or received by the loop antenna, and a cable connecting the loop antenna and electronic apparatus, wherein the antenna element is formed at a dielectric member of the vehicle and a conductor surface parallel to that antenna or having a slight inclination is provided near the antenna element.

As explained above, according to the loop antenna of the present invention, there are the effects that a circularly polarized wave antenna requiring use of only a single dielectric board, able to be kept down in cost, and providing a reception performance equivalent to a patch antenna, an antenna system using that antenna, and a vehicle mounting this antenna system can be realized.

BRIEF DESCRIPTION OF THE DRAWINGS

The present invention is illustrated by way of example, and not limitation, in the figures of the accompanying drawings in which like references indicate similar elements. Note that the following figures are not necessarily drawn to scale. In the figures.

DESCRIPTION OF THE PREFERRED EMBODIMENTS

Below, the attached drawings will be used to explain embodiments of the loop antenna of the present invention based on specific embodiments.

Figure 1A:
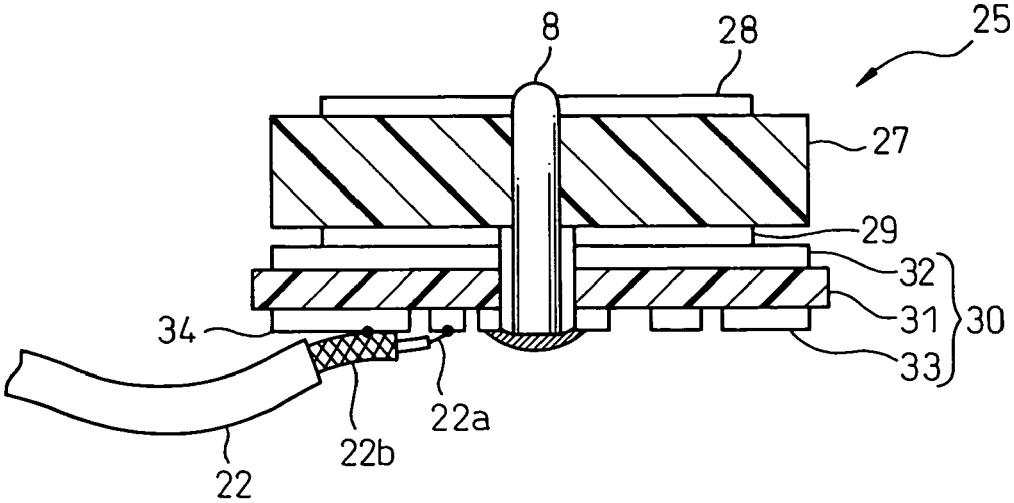
FIG. 1A is a sectional view showing the configuration of a conventional patch antenna.

First, the loop antenna of the present invention will be explained compared with a conventional patch antenna. FIG. 1A shows the structure of a conventional patch antenna 25. The patch antenna 25 is, in general, as shown in FIG. 1A, comprised of a dielectric board 27 on the top surface of which an antenna pattern (patch element) 28 is provided and on the bottom surface of which a ground pattern 29 is provided. The dielectric board 27 is comprised of a ceramic member with a high relative dielectric constant. In this example of a patch antenna 25, an amplifier 30 is provided under the ground pattern 29 of the dielectric board 27. The amplifier 30 is comprised of a dielectric board 31 on one surface of which a ground pattern 32 is formed and on the other surface of which an amplifier circuit pattern 33 is formed. The amplifier 30 is arranged with the ground pattern 32 superposed over the ground pattern 29 of the patch antenna 25.

Further, when a power use coaxial cable 22 is connected to the amplifier 30 side of the patch antenna 25, a power pin 8 connected to the patch element 28 is provided passing through the amplifier 30 and dielectric board 27. The other end of the power pin 8 connected to the patch element 28 at one end is soldered at the amplifier circuit pattern 33 of the amplifier 30. In this case, the coaxial cable 22 is connected at its center conductor 22*a* to the amplifier circuit pattern 33 by soldering, while is connected at its external conductor 22*b* to the ground pattern 34 on the amplifier circuit pattern 33 by soldering. Usually, this patch antenna 25 is accommodated in a plastic housing.

The patch element 28 is designed to be able to receive a circularly polarized wave sent from a GPS satellite. When the wavelength of the reception frequency is λ, as shown in FIG. 1C, it is provided with a λ/2-sided square antenna element. When the patch element 28 receives a relatively low frequency like a wave from a GPS satellite, a high dielectric constant board may be used to reduce the size.

As opposed to this, the loop antenna 10 of the present invention able to receive a circularly polarized wave is accommodated in a dome-shaped plastic container 16. The dome-shaped container 16 is provided inside it with a ring-shaped holding projection 17 parallel to the floor. The dielectric board 11 is placed on the holding projection 17. The dielectric board 11 is provided on its front surface with the antenna element 12 and a low noise amplifier (LNA) 13 connected to this antenna element 12. The low noise amplifier 13 has a coaxial cable 22 provided with a center conductor 22*a* and an external conductor 22*b* connected to it. On the other hand, the dielectric board 11 is provided on its back surface at the opposite side from the low noise amplifier 13 with a ground pattern 14. This ground pattern 14 is for example a mat pattern and is provided on the dielectric board 11 at the part under the low noise amplifier 13.

Further, the dome-shaped container has a metal plate 15 laid at its floor. The metal plate 15 is separated from the antenna element 12 by exactly a predetermined distance. By providing this metal plate 15, the metal plate 15 acts as a reflector and improves the reception performance with respect to waves arriving from the side directions of the dome. In the loop antenna 10 of this embodiment, the antenna element 12 is designed to receive a circularly polarized wave sent from a GPS satellite and, as shown in FIG. 1D, is comprised of a λ/4-sided square loop element 12A. Further, near this square loop element 12A, a parasitic element 12B not contacting the loop element 12A is provided.

The loop antenna 10 of this embodiment, being configured in the above way, can be made smaller in the antenna element 12 compared with the conventional patch antenna 25 explained with reference to FIG. 1A and FIG. 1C, so can be made smaller in size.

Figure 1B:
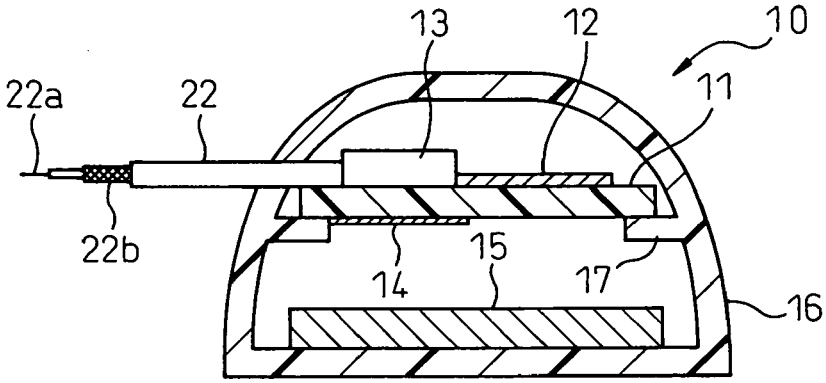
FIG. 1B is a sectional view of the configuration of an embodiment of the loop antenna of the present invention.
Figure 1C:
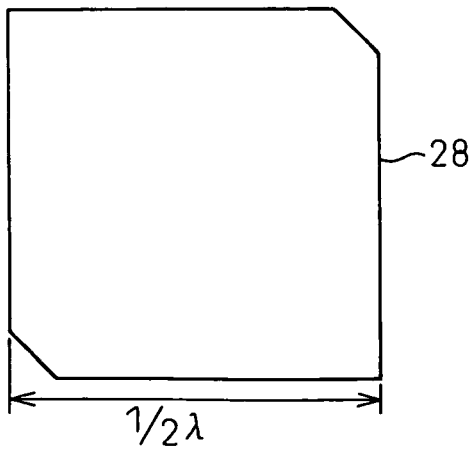
FIG. 1C is a plan view showing the shape and size of an antenna element of the patch antenna of FIG. 1A.
Figure 1D:
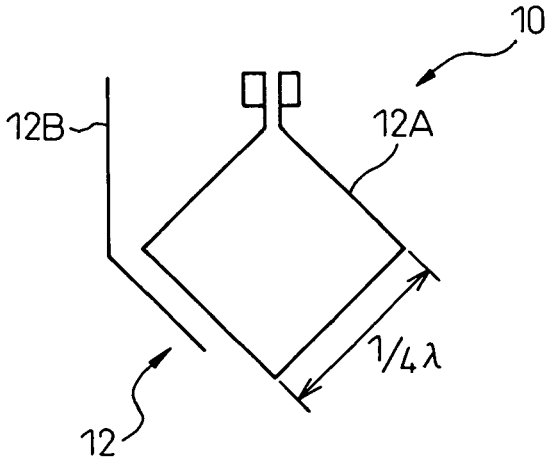
FIG. 1D is a plan view showing the shape and size of an antenna element of the loop antenna of the present invention.
Figure 2A:
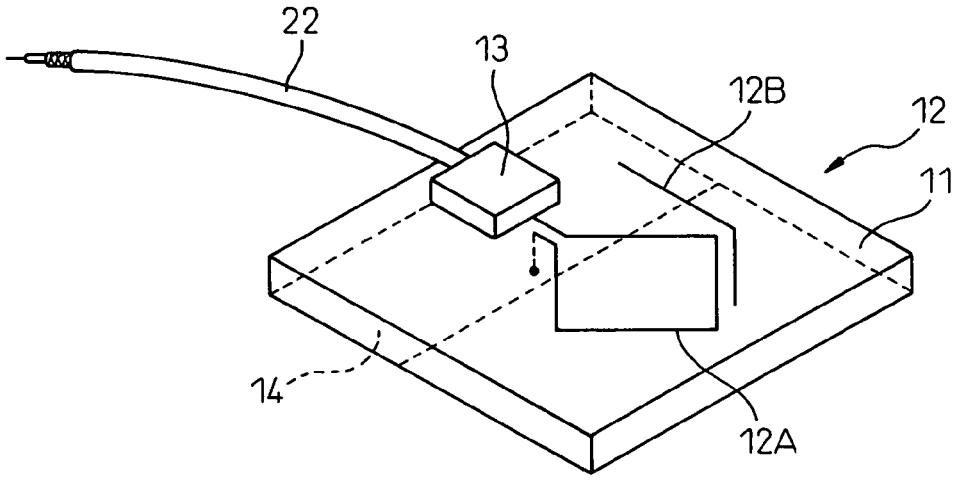
FIG. 2A is a perspective view showing an example of arrangement of the antenna element of the loop antenna shown in FIG. 1B and a low noise amplifier on a dielectric board.

FIG. 2A shows an example of the arrangement of the antenna element 12 (loop element 12A and parasitic element 12B) of the loop antenna 10 shown in FIG. 1B and the low noise amplifier 13 on the dielectric board 11. One of the loop element 12A provided on one surface of the dielectric board 11 is connected to the low noise amplifier 13, while the other end passes through the dielectric board 11 and is connected to the ground pattern 14 provided on the other surface of the dielectric board 11 (bottom surface). The dielectric board 11 can be made a transparent glass plate.

The ground pattern 14, in this embodiment, is provided at a region of about half of the bottom surface of the dielectric board 11 (low noise amplifier 13 side). However, the ground pattern 14 may also be provided extended to the part directly under the antenna element 12.

Figure 2B:
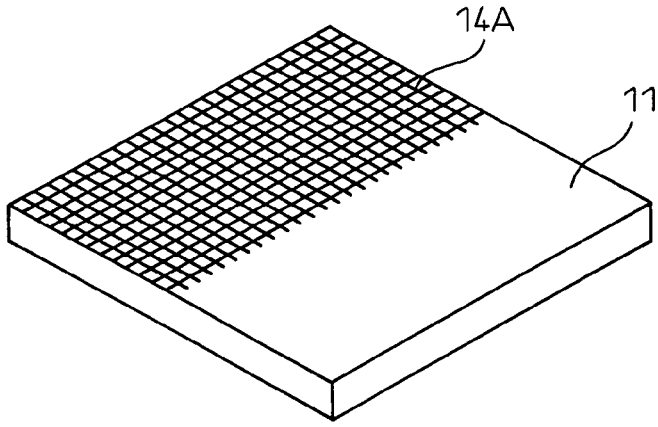
FIG. 2B is a perspective view showing an example of a pattern on a back surface of the dielectric board shown in FIG. 2A.
Figure 2C:
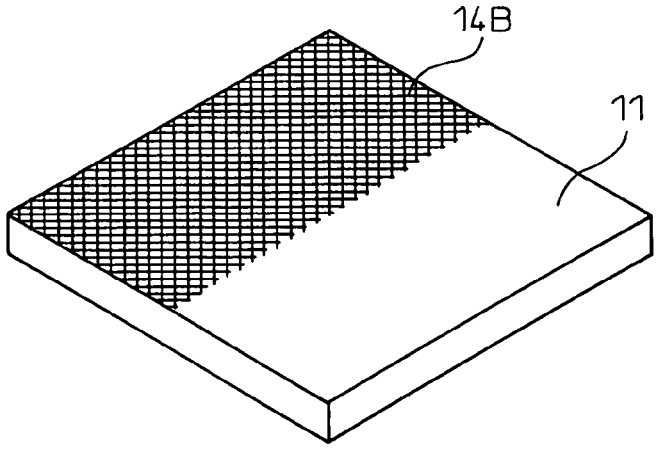
FIG. 2C is a perspective view showing another example of a pattern on a back surface of the dielectric board shown in FIG. 2A.

Further, the ground pattern 14 is usually a mat pattern, but a mesh conductor 14A of the pattern shown in FIG. 2B or a mesh conductor 14B of the pattern shown in FIG. 2C may also be used instead of the ground pattern 14. The mesh should have a pitch of λ/10 or so. The distance between the metal plate 15 and the antenna element 12 in the thickness direction of the dielectric board 11 is ideally λ/4.

Figure 3A:
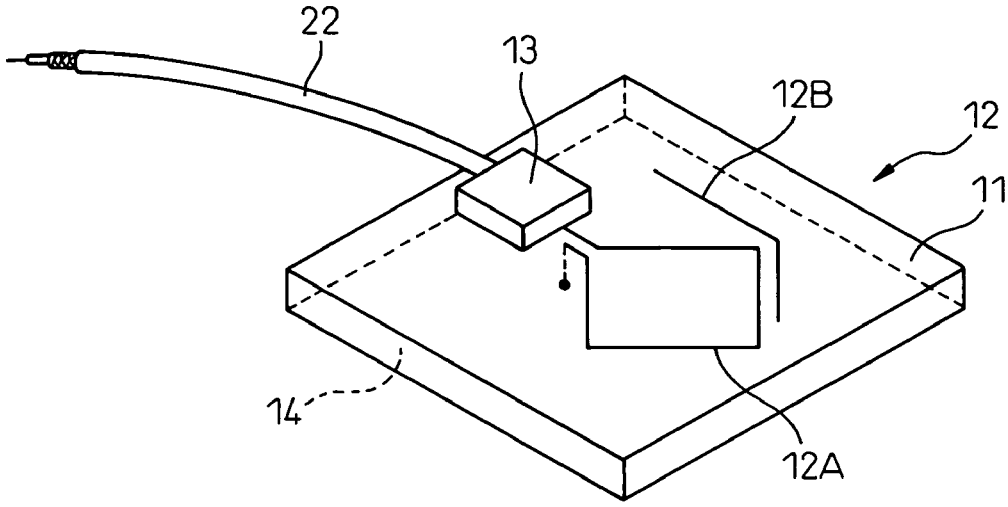
FIG. 3A is a perspective view showing another example of the antenna element of the loop antenna shown in FIG. 2A and a ground pattern on the bottom surface of the dielectric board of a low noise amplifier.
Figure 3B:
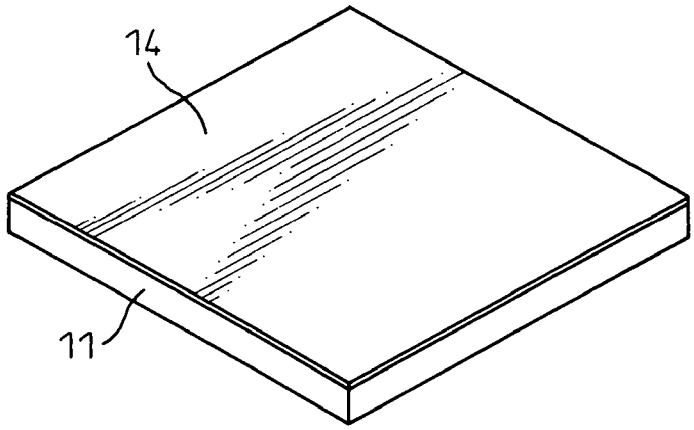
FIG. 3B is a perspective view of the dielectric board shown in FIG. 3A as seen from the back surface.
Figure 3C:
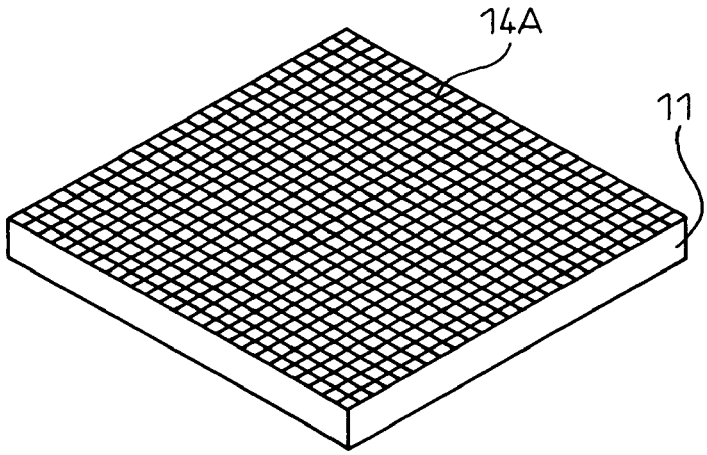
FIG. 3C and FIG. 3D are perspective views of other examples of patterns on the back surface of the dielectric board shown in FIG. 3B.
Figure 3D:
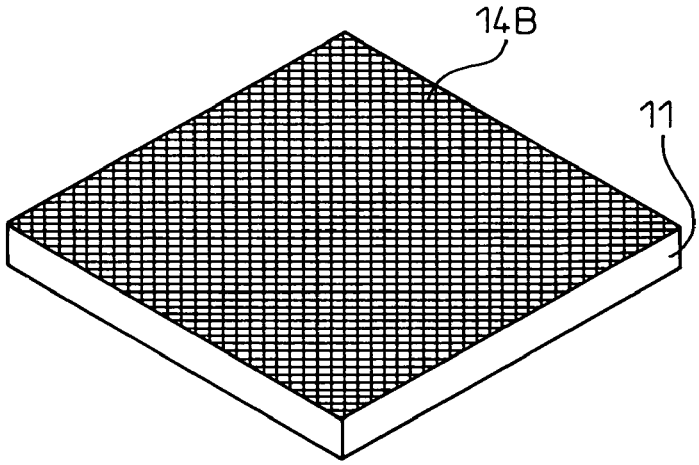

Note that the ground pattern 14 provided at the bottom surface of the dielectric board 11 shown in FIG. 2A, as shown in FIG. 3A, may also be provided at the entire bottom surface of the dielectric board 11. In this case, the ground pattern 14 extended to directly under the antenna element 12 also serves as the metal plate 15 shown in FIG. 1B. The ground pattern 14 provided at the entire bottom surface of the dielectric board 11 may also be made the mat pattern shown in FIG. 3B. Further, it may also be made the mesh conductor 14A of the pattern shown in FIG. 3C or mesh conductor 14B of the pattern shown in FIG. 3D.

Figure 3E:
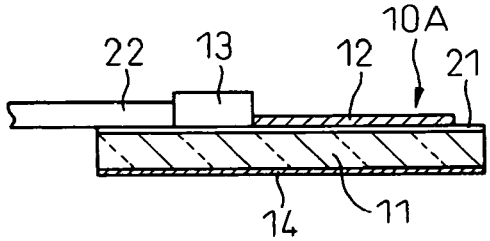
FIG. 3E is a side sectional view of an embodiment where the antenna element is formed on a film.

Further, the antenna element 12, as shown in FIG. 3E, may be attached to a dielectric board 11 as a film loop antenna 10A comprised of a sheet-like transparent film 21 on which an antenna element 12 is formed. Instead of this film loop antenna 10A, as shown in FIG. 3F, it is also possible to use a film loop antenna 10B comprised of a sheet-like transparent film 21 formed with a ground pattern 26 on the surface on which the antenna element 12 is not formed.

Figure 3F:
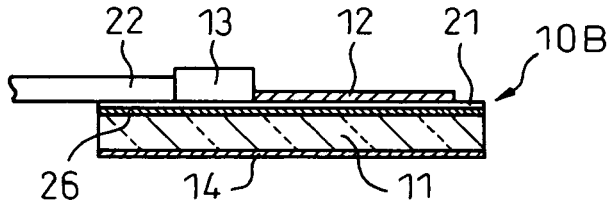
FIG. 3F is a side sectional view showing a modification of the embodiment where the antenna element is formed on a film.
Figure 3G:
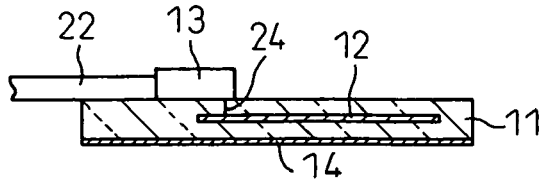
FIG. 3G is a side sectional view showing an embodiment where the antenna element is buried in a dielectric board.

Further, the antenna element 12, as shown in FIG. 3G, may be formed embedded in the dielectric board 11. In this case, the antenna element 12 and the low noise amplifier 13 should be connected by a via 24. Further, the ground pattern 14 may be formed by a transparent member and may be formed by a transparent member on a transparent sheet.

Note that in the case of the embodiment of FIG. 3F, the dielectric board 11 and the ground pattern 14 become close in distance, so if the ground pattern 14 is provided only under the low noise amplifier 13 as shown in FIG. 1B, the loop antenna is improved in performance in some cases.

Figure 4A:
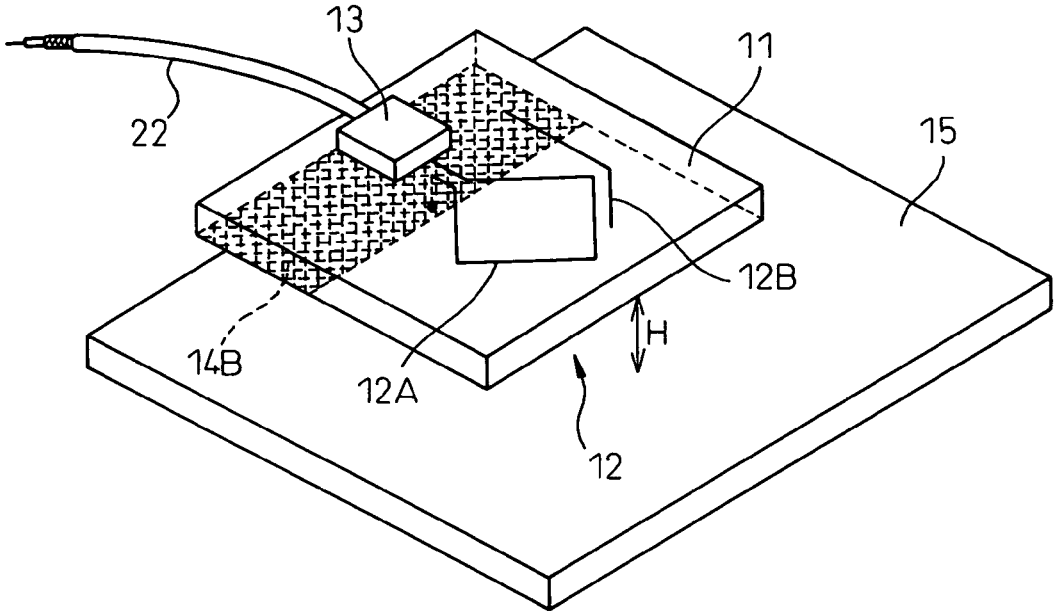
FIG. 4A is a perspective view showing the positional relationship between the dielectric board shown in FIG. 1B and a metal plate.

FIG. 4A shows the positional relationship between the dielectric board 11 and metal plate 15 shown in FIG. 1B. In this embodiment, the mesh conductor 14B is provided as the ground pattern at the region of about half of the bottom surface of the dielectric board 11 (low noise amplifier 13 side). Further, there is a predetermined distance H between the dielectric board 11 and the metal plate 15.

Figure 4B:
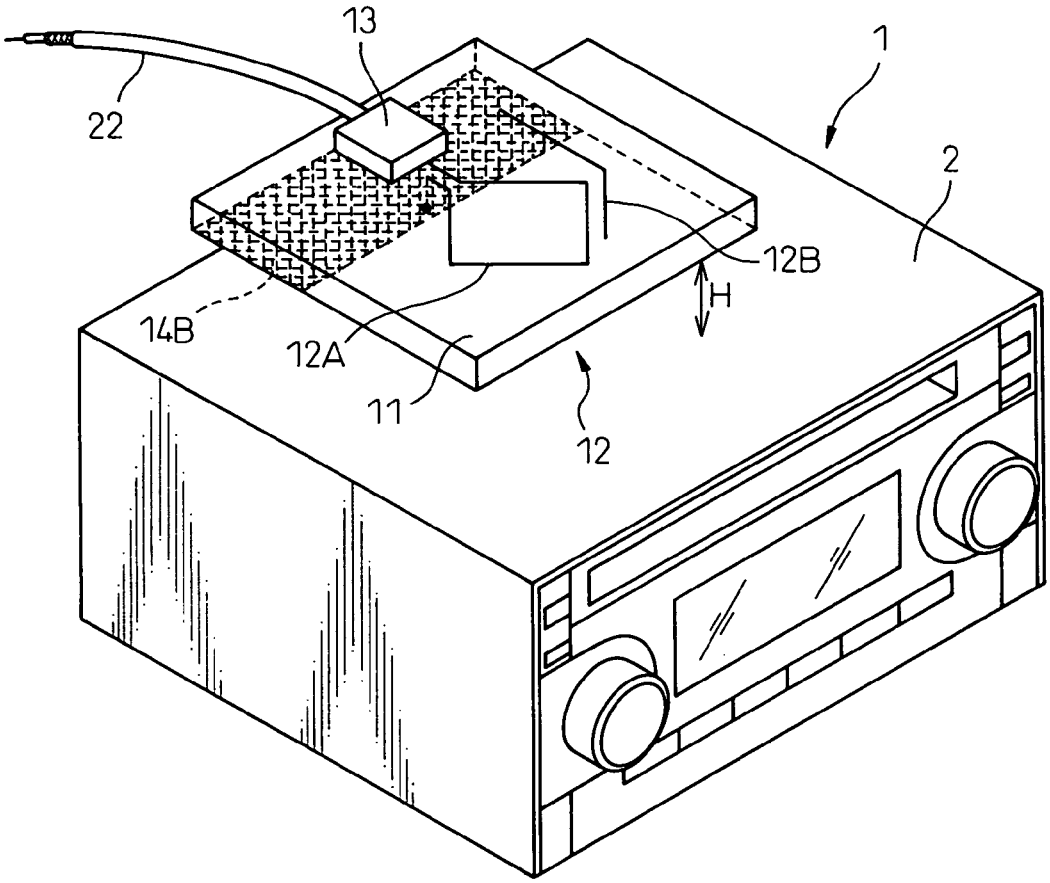
FIG. 4B is a perspective view showing an embodiment where the metal plate of FIG. 4A is replaced by a metal housing of an electronic apparatus.
Figure 5:
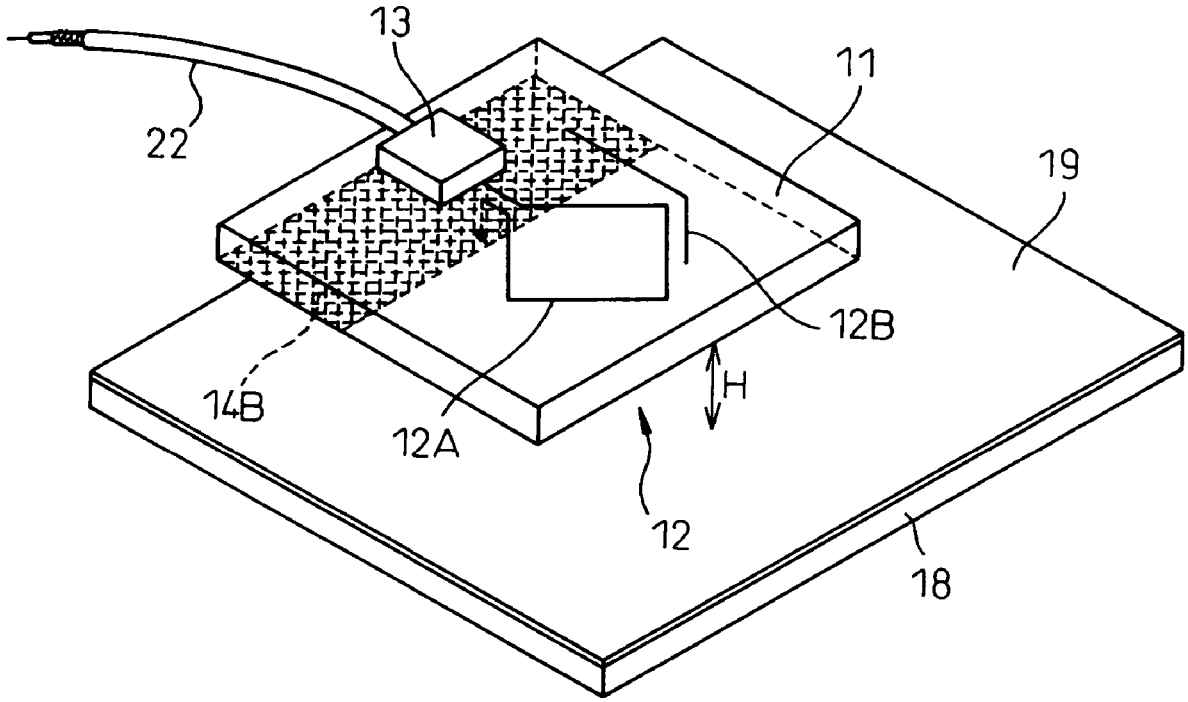
FIG. 5 is a perspective view showing an embodiment where the metal plate shown in FIG. 4A is replaced by a dielectric board provided with a ground pattern.

FIG. 4B shows an embodiment where the metal plate 15 of FIG. 4A is replaced by a metal housing 2 of an electronic apparatus 1. The electronic apparatus 1 is for example a car navigation system or audio system mounted in the automobile. In this case as well, a predetermined distance H is provided between the metal housing 2 of the electronic apparatus 1 and the dielectric board 11. Note that instead of the metal plate 15 shown in FIG. 5 and FIG. 3A, it is also possible to use a dielectric board 18 of the same size as the metal plate 15 over the entire surface of which the ground pattern 19 is provided.

Figure 6A:
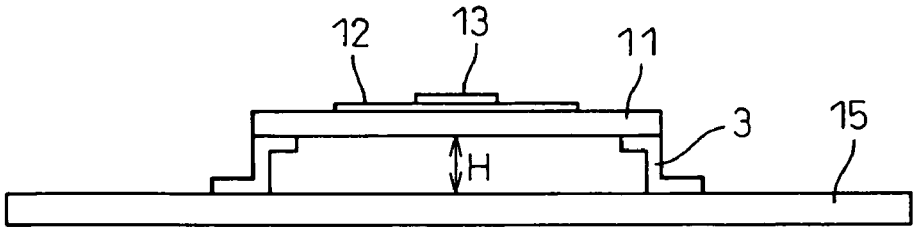
FIG. 6A is a side view of an example of fastening the dielectric board shown in FIG. 4A and a metal plate by L-shaped fastenings.

FIG. 6A shows an example of a method of separating the dielectric board 11 and metal plate 15 shown in FIG. 4A by exactly a predetermined distance H. To separate the dielectric board 11 and the metal plate 15 by exactly a predetermined distance H, it is sufficient to fasten the two ends of the dielectric board 11 over the dielectric board 11 separated from the dielectric board 11 by exactly a predetermined distance H using the L-shaped attachments 3 shown in FIG. 6C.

Figure 6B:
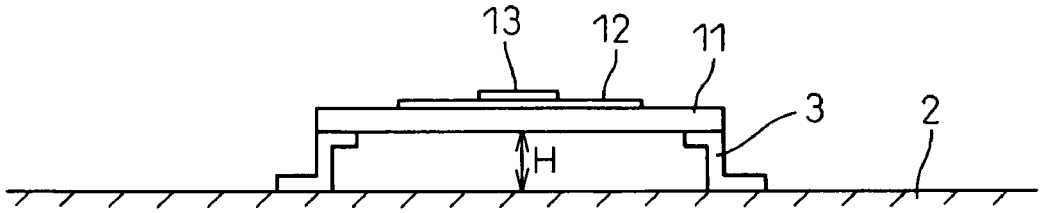
FIG. 6B is a side view of an example of fastening the dielectric board shown in FIG. 4B and a metal housing of an electronic apparatus by L-shaped fastenings.
Figure 6C:
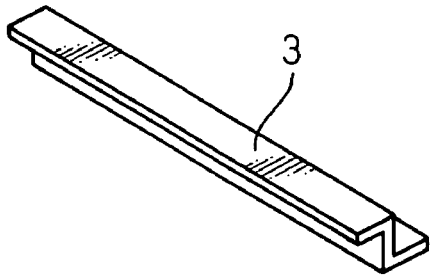
FIG. 6C is a perspective view showing the configuration of an L-shaped fastening used in FIGS. 6A and 6B.

FIG. 6B shows an example of fastening the dielectric board 11 above the metal housing 2 of the electronic apparatus 1 shown in FIG. 4B by the L-shaped attachments 3. These L-shaped attachments 3 may be made of metal or plastic. Further, the L-shaped attachments 3 and the dielectric board 11, metal plate 15, or metal housing 2 of the electronic apparatus 1 may be joined by screws or an adhesive.

Figure 6D:
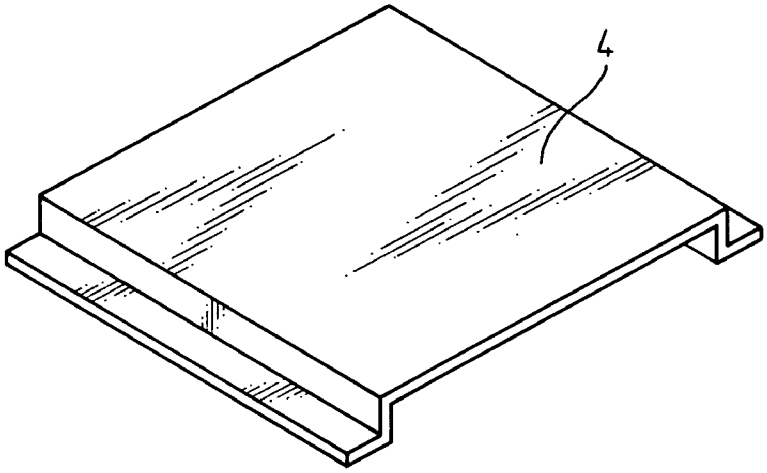
FIG. 6D is a perspective view showing an embodiment of a gate-type fastening.
Figure 6E:
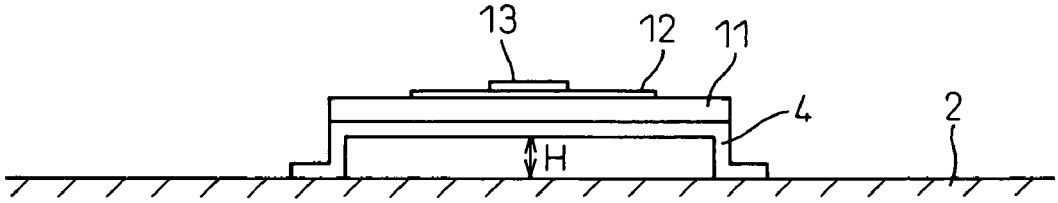
FIG. 6E is a side view showing the state of using the gate-type fastening of FIG. 6D to fasten the dielectric board shown in FIG. 5A to a metal plate or a dielectric.
Figure 6F:
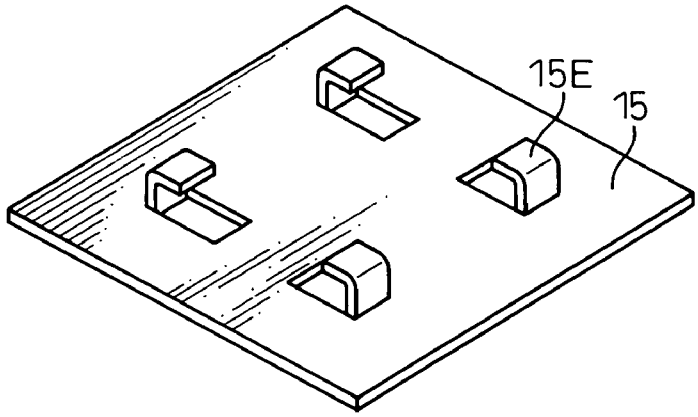
FIG. 6F is a perspective view of a metal plate showing an embodiment of forming attachments at the metal plate itself.

Further, rather than fastening L-shaped attachments 3 on the metal plate 15, as shown in FIG. 6F, parts of the metal plate 15 may be cut and bent upward to the dielectric board 11 side in shapes similar to the above-mentioned L-shaped attachments 3 so as to form extended parts 15E and these extended part 15E used to support the dielectric board 11.

On the other hand, the dielectric board 11 and metal plate 15 or the dielectric board 11 and metal housing 2 of the electronic apparatus 1 may be connected using a gate-type attachment 4 shown in FIG. 6D. FIG. 6E shows the state of using the gate-type attachment 4 to fasten the dielectric board 11 on the metal housing 2 of the electronic apparatus 1 shown in FIG. 4B. The gate-type attachment 4 in the case may be made of plastic or metal.

Figure 7A:
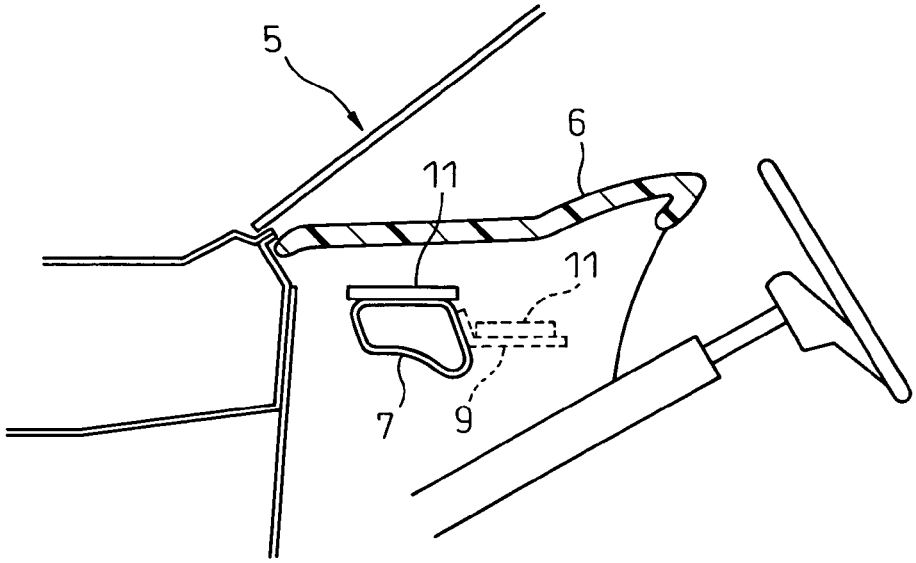
FIG. 7A is a sectional view of principal parts of an automobile showing an example of providing a dielectric board on which the loop antenna of the present invention is set above part of the frame inside an automobile instrument panel.
Figure 7B:
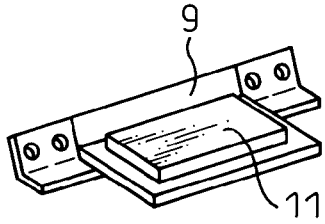
FIG. 7B is a perspective view showing the configuration of an example of a bracket in the case of attaching a dielectric board on which the loop antenna of the present invention is provided at the position shown by the broken line in FIG. 7A.

FIG. 7A shows an embodiment where the dielectric board 11 provided with the loop antenna 10 of the present invention is placed above the part of the chassis frame 7 inside the instrument panel of the automobile 5. Since the chassis frame 7 is metal, this chassis frame 7 can be used instead of the above-mentioned metal plate 15. Further, it is possible to fasten a metal bracket 9 shown in FIG. 78 at a position shown by the broken line at the side face of the metal chassis frame 7 and place the dielectric board 11 provided with the loop antenna 10 of the present invention over this.

Figure 7C:
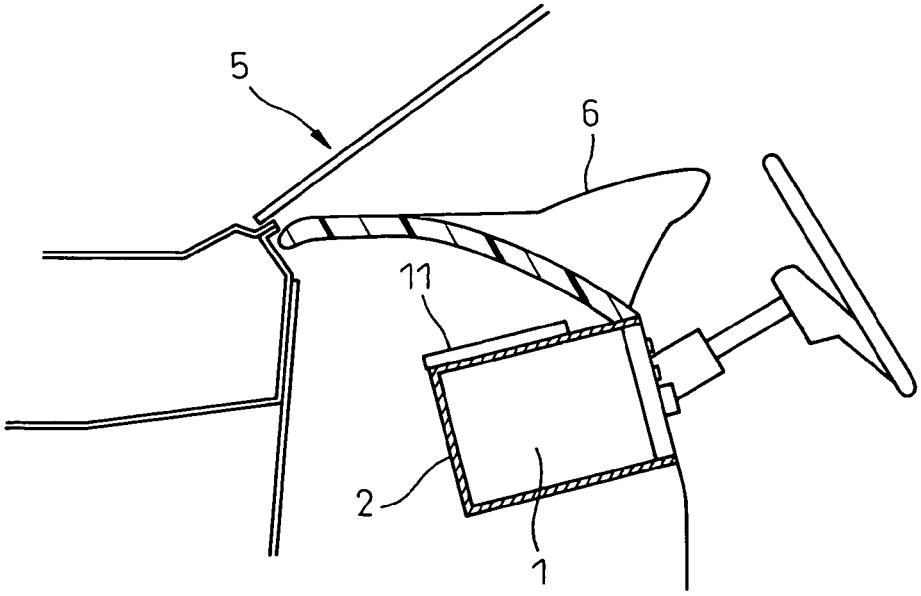
FIG. 7C is a sectional view of principal parts of an automobile showing an example of providing a dielectric board on which the loop antenna of the present invention is set on top of a metal housing of an electronic apparatus provided inside an automobile instrument panel.

FIG. 7C shows an embodiment where the dielectric board 11 provided with the loop antenna 10 of the present invention is placed above the metal housing of the electronic apparatus 1 provided at the instrument panel of the automobile 5 etc. In this way, in the present invention, when providing the loop antenna 10 inside the instrument panel of the automobile 5, it is possible to use a metal member inside the instrument panel instead of the metal plate 15 shown in FIG. 1B.

Figure 8:
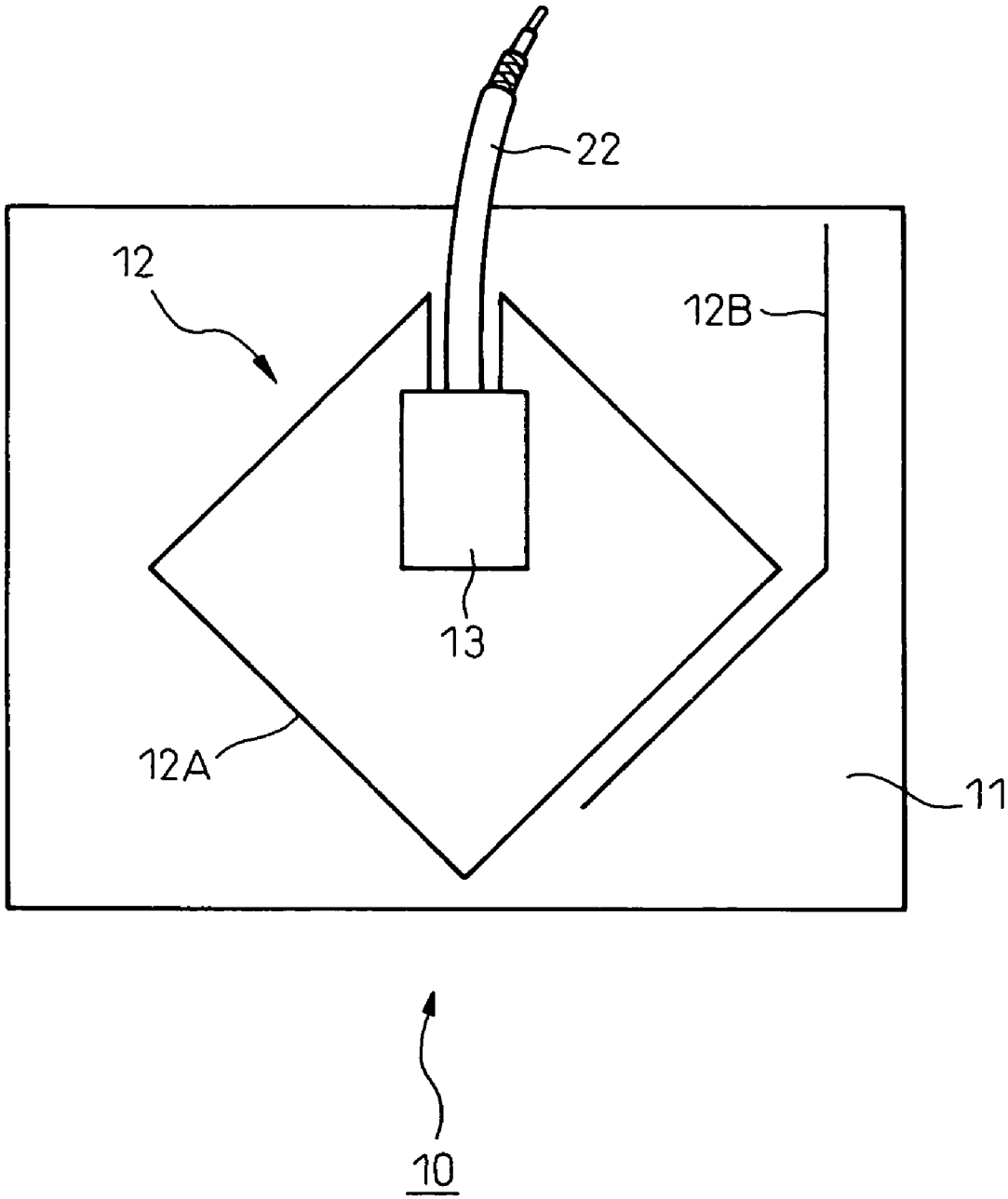
FIG. 8 is a view of another embodiment of the arrangement of the antenna element of the loop antenna of the present invention and a low noise amplifier on a dielectric board.

FIG. 8 shows another embodiment of provision of the antenna element 12 (loop element 12A and parasitic element 12B) of the loop antenna 10 of the present invention and the low noise amplifier 13 on the dielectric board 11. In the above-mentioned embodiments, the low noise amplifier 13 was provided outside the loop of the loop element 12A of the loop antenna 10. On the other hand, in this embodiment, the low noise amplifier 13 is provided inside the loop element 12A of the loop antenna 10. Even if providing the low noise amplifier 13 inside the loop of the loop element 12A of the loop antenna 10, there is no effect on the reception performance of the loop antenna 10, the dielectric board 11 can be made smaller in size, and in turn the loop antenna 10 can be made smaller in size. In this case, the ground pattern can be made the same rectangular shape as the low noise amplifier 13 (same shape and same size).

Figure 9:
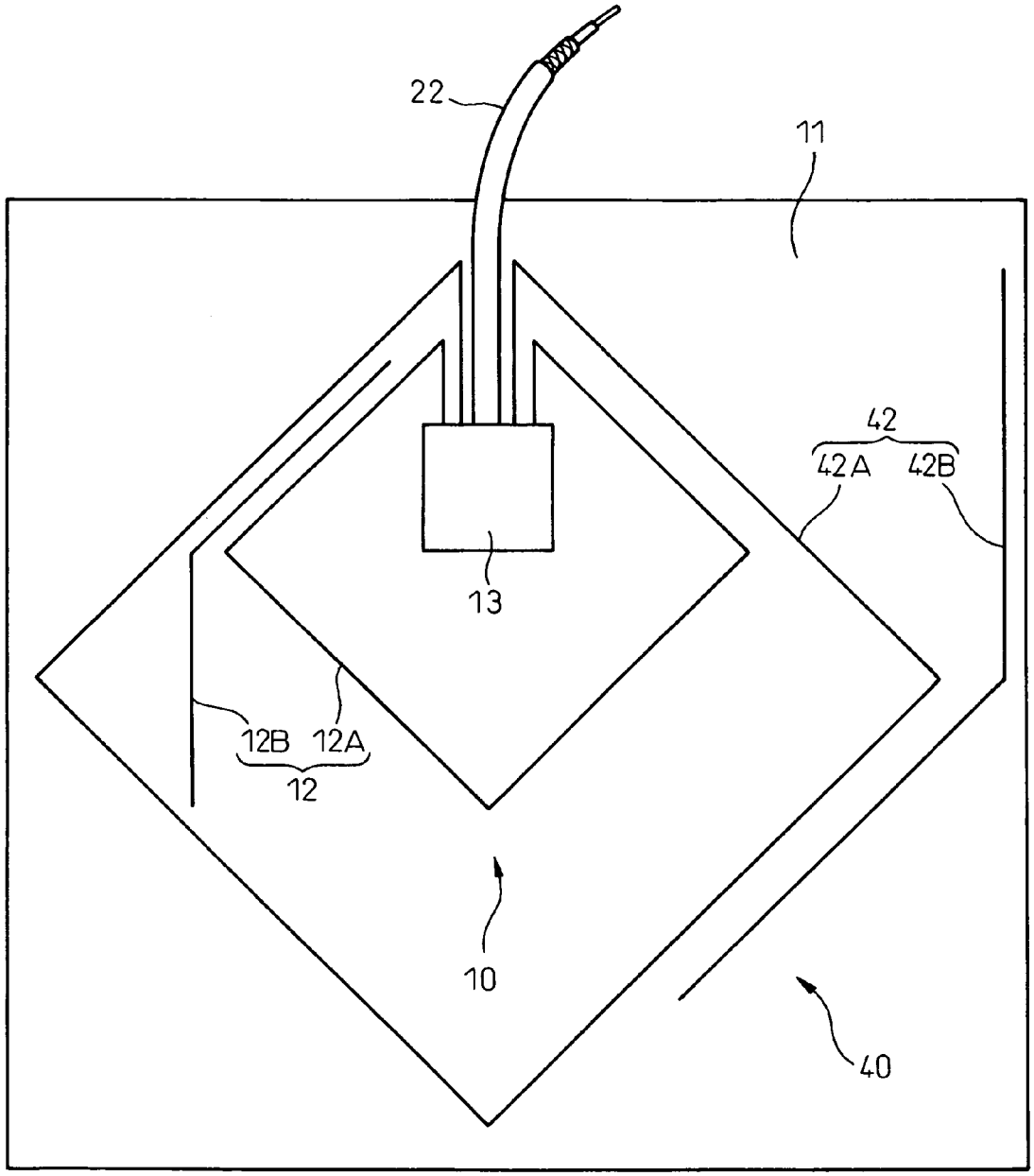
FIG. 9 is a view of a modification of the arrangement of the antenna element of the loop antenna of the present invention and the low noise amplifier on the dielectric board shown in FIG. 8 and shows the arrangement of two types of antenna elements of a loop antenna and a low noise amplifier on a dielectric board.

FIG. 9 shows a modification of the provision of the antenna element 12 (loop element 12A and parasitic element 12B) of the loop antenna 10 of the present invention and the low noise amplifier 13 on the dielectric board 11 shown in FIG. 8. In the embodiment shown in FIG. 8, only one type of loop antenna 10 was provided on the dielectric board 11, but in this embodiment, in addition to the loop antenna 10, another loop antenna 40 is provided on the dielectric board 11.

The antenna element 42 of the loop antenna 40, like the loop antenna 10, is provided with a loop element 42A and a parasitic element 42B, but the low noise amplifier 13 is used in common with the loop antenna 10. The loop antenna 40 is for receiving a circularly polarized wave of a frequency lower than the loop antenna 10. Note that in this embodiment, the parasitic element 12B is positioned differently from FIG. 8, but even if the parasitic element is provided at a position rotated 180 degrees about the center of the loop of the loop antenna, the function is the same. Further, by using the low noise amplifier 13 in common for the loop antennas 10 and 40, it is possible to reduce the cost and make the antenna smaller. In this case, the ground pattern can be made the same rectangular shape as the low noise amplifier 13 (same shape and same size).

Figure 10A:
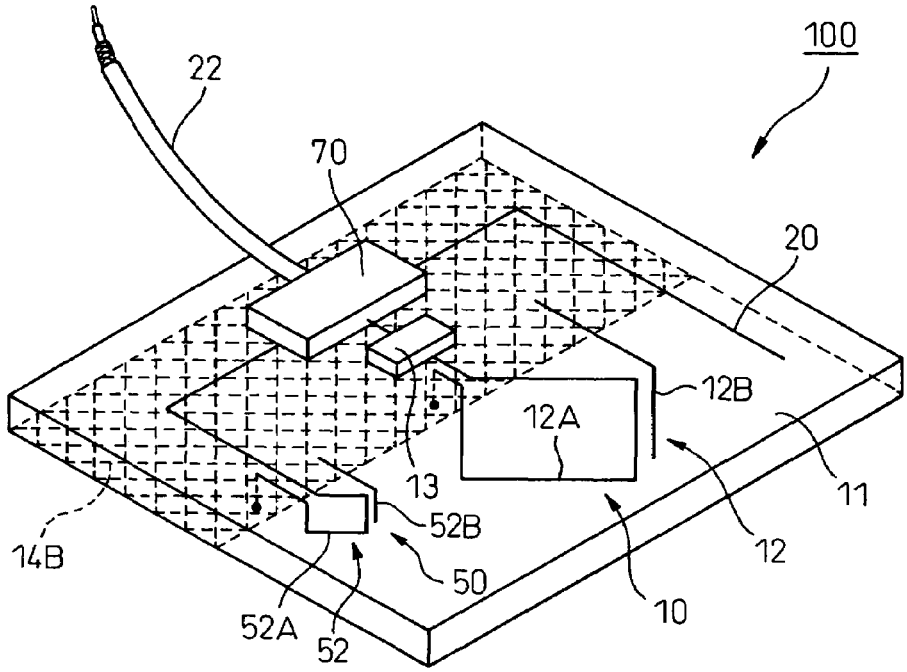
FIG. 10A is a perspective view showing an embodiment where a dielectric board on which the loop antenna of the present invention is provided is provided with a loop antenna separate from the other antenna on so as to form an integrated antenna.

FIG. 10A shows an embodiment where the dielectric board 11 provided with the loop antenna 10 of the present invention is provided with a loop antenna 50 separate from the other antenna (monopole antenna) 20 so as to form an integrated antenna 100 on the dielectric board 11. The loop antenna 10 receives waves from a GPS satellite and, in the same way as the above-mentioned embodiment, is provided with an antenna element 12 comprised of a loop element 12A and parasitic element 12B and a low noise amplifier 13. Further, the output of the low noise amplifier 13 is input to a combiner/distributor 70. The monopole antenna 20 is a VICS antenna and is directly connected to the combiner/distributor 70. Further, the loop antenna 50 is an electronic toll collector antenna and is provided with an antenna element 52 comprised of a loop element 52A and parasitic element 52B. One end of the loop element 52A is connected to the ground pattern 14B provided at the bottom surface of the dielectric board 11, while the other end is directly connected to the combiner/distributor 70.

Figure 10B:
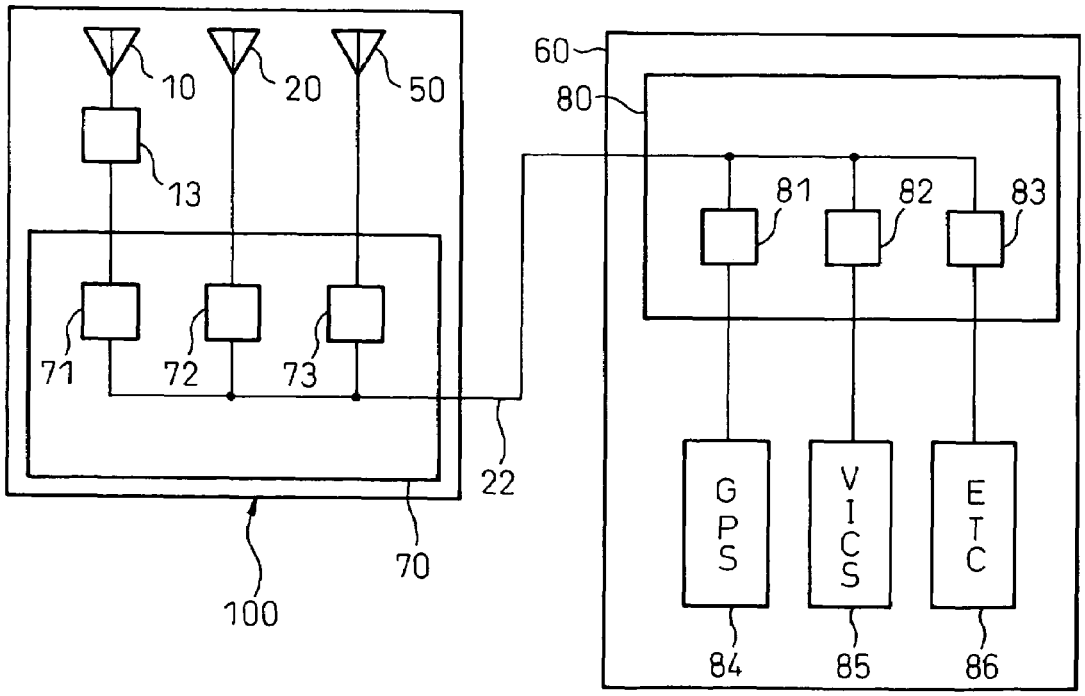
FIG. 10B is a view of the circuit configuration in the case of connecting the integrated antenna shown in FIG. 10A to a receiver and transmitter.

FIG. 10B shows the circuit configuration in the case of connecting the integrated antenna 100 shown in FIG. 10A to the receiver/transmitter 80. The wave received by the GPS loop antenna 10 is amplified by the low noise amplifier 13, then input to the combiner/distributor 70, passed through a filter 71, then combined. The wave received by the VICS monopole antenna 20 is input to the combiner/distributor 70, passed through a filter 72, then combined. The wave received by the electronic toll collector loop antenna 50 is input to the combiner/distributor 70, passed through the filter 73, then combined.

The signal combined at the combiner/distributor 70 of the integrated antenna 100 is led by the coaxial cable 22 to the combiner/distributor 80 housed in the receiver/transmitter 60. The combined signal is distributed at the combiner/distributor 80, passed through the filters 81, 82, and 83, and input to the GPS receiver 84, VICS receiver 85, and electronic toll collector receiver 86 for processing. As the receiver/transmitter 60, for example, there is a navigation system.

Figure 11A:
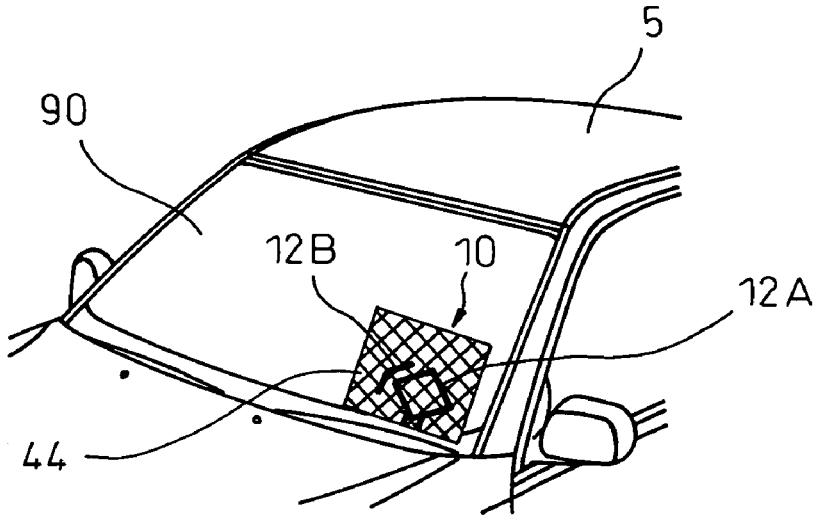
FIG. 11A is a partial perspective view of an embodiment in which the loop antenna of the present invention is provided on an automobile front windshield.

FIG. 11A shows an example where the loop antenna 10 of the present invention is attached to the front windshield 90 of the automobile 5. The loop antenna 10 is kept from interfering with the field of vision of the driver by being provided at the bottom of the front windshield 90. The loop antenna 10 includes the loop element 12A and the parasitic element 12B. The mesh ground pattern (mesh wire) 44 is provided further inward toward the passenger compartment than these elements.

Figure 11B:
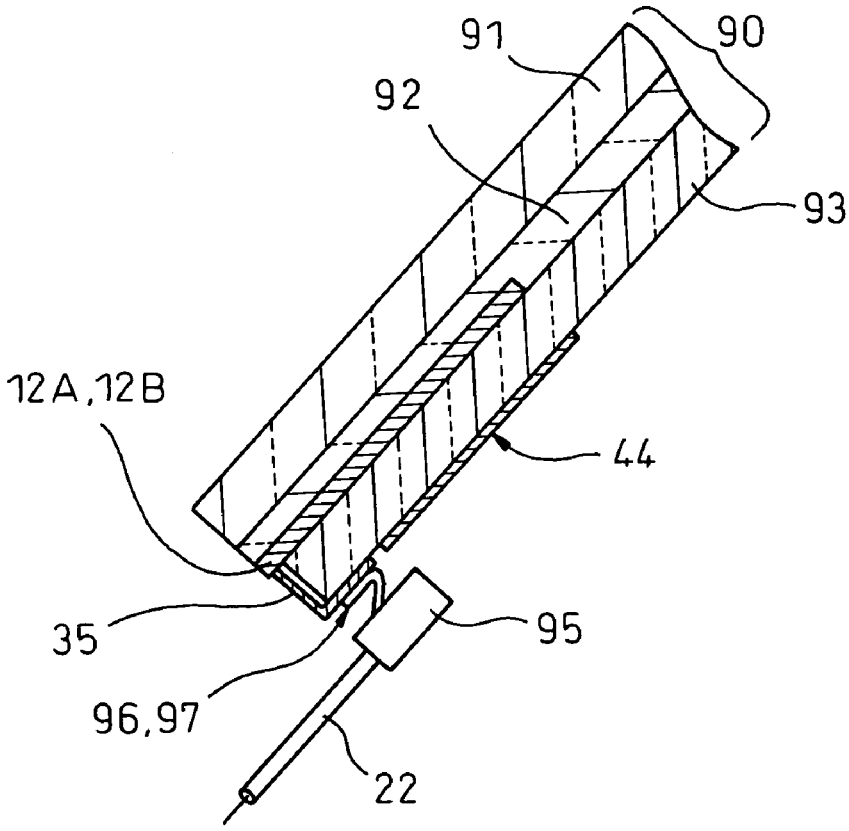
FIG. 11B is a partial sectional view of a part of a front windshield of FIG. 11A at which the loop antenna is provided.

FIG. 11B shows a cross-section of the location of the front windshield 90 shown in FIG. 11A where the loop antenna 10 is provided. The front windshield 90 is comprised of laminated glass including outside glass 91, a resin sheet 92, and inside glass 93. The antenna element and the parasitic elements 12A, 12B are formed in the intermediate resin sheet 92. Further, the mesh wire 44 is formed at the inside of the inside glass 93 (inside the compartment). The antenna element 12A formed at the resin sheet 92 is led out by wires 35 to the passenger compartment side of the inside glass 93 and connected to a connector 95 at connection terminals 96 and 97.

Figure 12A:
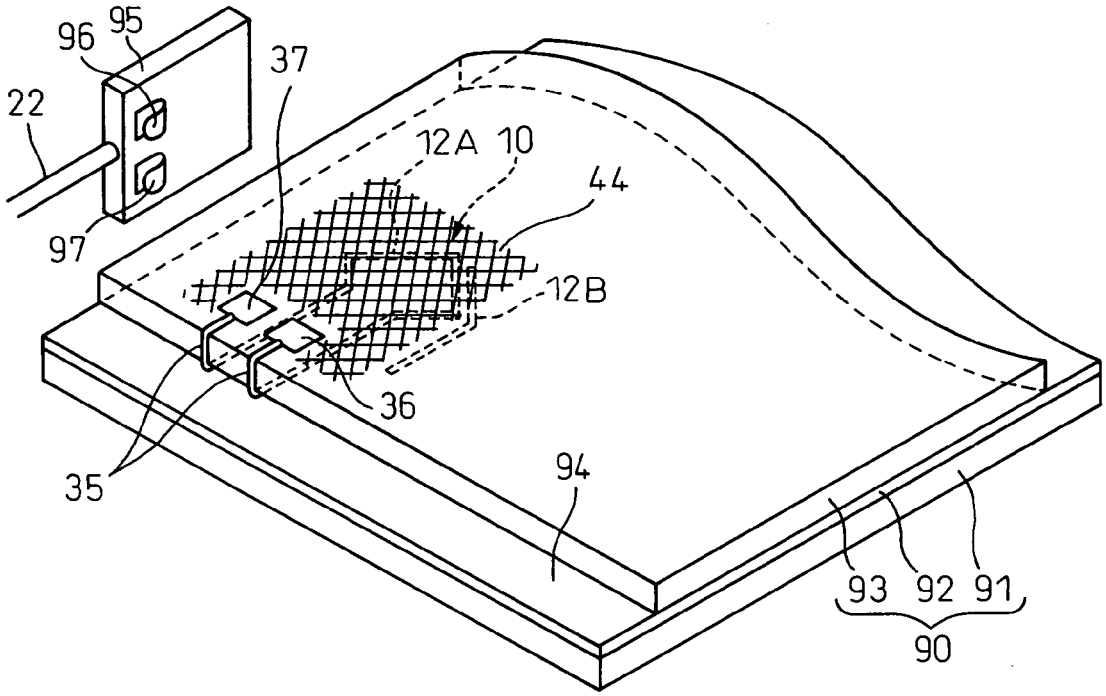
FIG. 12A is a perspective view showing an embodiment of connection with a connector in the case of forming the loop antenna of the present invention in an automobile front windshield.

FIG. 12A shows an embodiment of connection of the front windshield 90 of the automobile provided with the loop antenna 10 of the present invention and the connector 95. The front windshield 90 of this embodiment is comprised of laminated glass including outside glass 91, a resin sheet 92, and inside glass 93. The ends in the lateral direction are formed with step differences 94. The loop antenna 10 of the present invention is embedded in part of the resin sheet 92 in advance at the stage of production of the front windshield 90. The two ends of the loop element 12A are led out by wires 35 to a step difference 94 of the front windshield 90. Further, the wires 35 are bent to the inside glass 93 side at the step difference 94 and are connected to the connection terminals 36 and 37 provided at the surface of the passenger compartment side of the inside glass 93.

The resin sheet 92 has transparency to secure visibility. Note that it is also possible not to provide the resin sheet 92 and to just provide the antenna elements 12A and 12B between the outside glass 91 and inside glass 92. Further, around the loop antenna 10 (surface at passenger compartment side of inside glass 93), as illustrated, metal mesh wire 44 is provided instead of the metal plate. When using a transparent conductor as the metal plate, it is possible to use a mat pattern, but if using a usual metal, with a mat pattern, the driver would not be able to see through it, so mesh wire 44 is used instead of the metal plate to improve the visibility through the glass. Further, the mesh wire 44 may be formed by a transparent conductor so as to further improve the visibility.

Figure 13A:
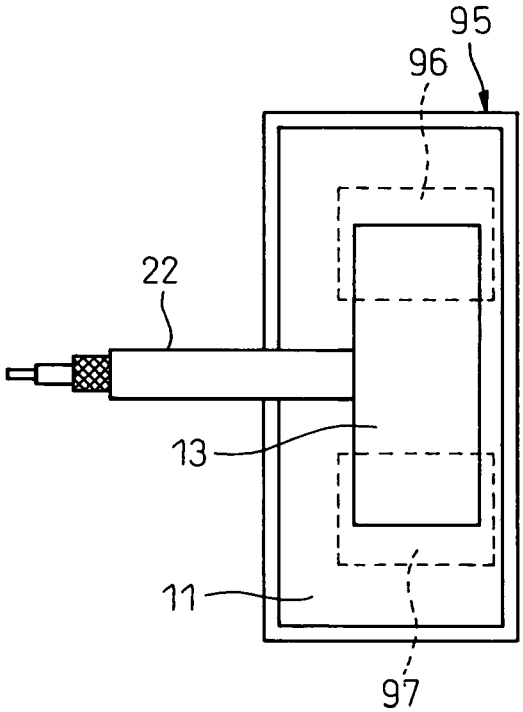
FIG. 13A is a plan view showing the internal configuration of the connector of FIG. 12A.
Figure 13B:
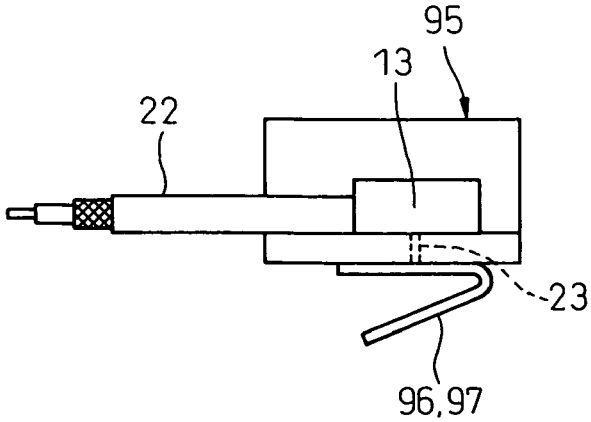
FIG. 13B is a side view of the connector of FIG. 13A.

The connector 95 for connecting with the connection terminals 36 and 37 provided at the inside compartment side of the inside glass 93 is provided with a plastic housing provided with connection terminals 96, 97 having springiness. Inside the connector 95, as shown in FIGS. 13A and 13B, the dielectric board 11 is housed. Above this dielectric board 11 is the low noise amplifier 13. The coaxial cable 22 is connected to the low noise amplifier 13, while the connection terminals 96, 97 with springiness are connected by through holes 23 to the low noise amplifier 13. Further, this connector 95 is attached by two-sided adhesive tape, adhesive, or other means to the front windshield 90 so that the connection terminals 96, 97 are connected to the connection terminals 36, 37 on the inside glass 93.

Figure 12B:
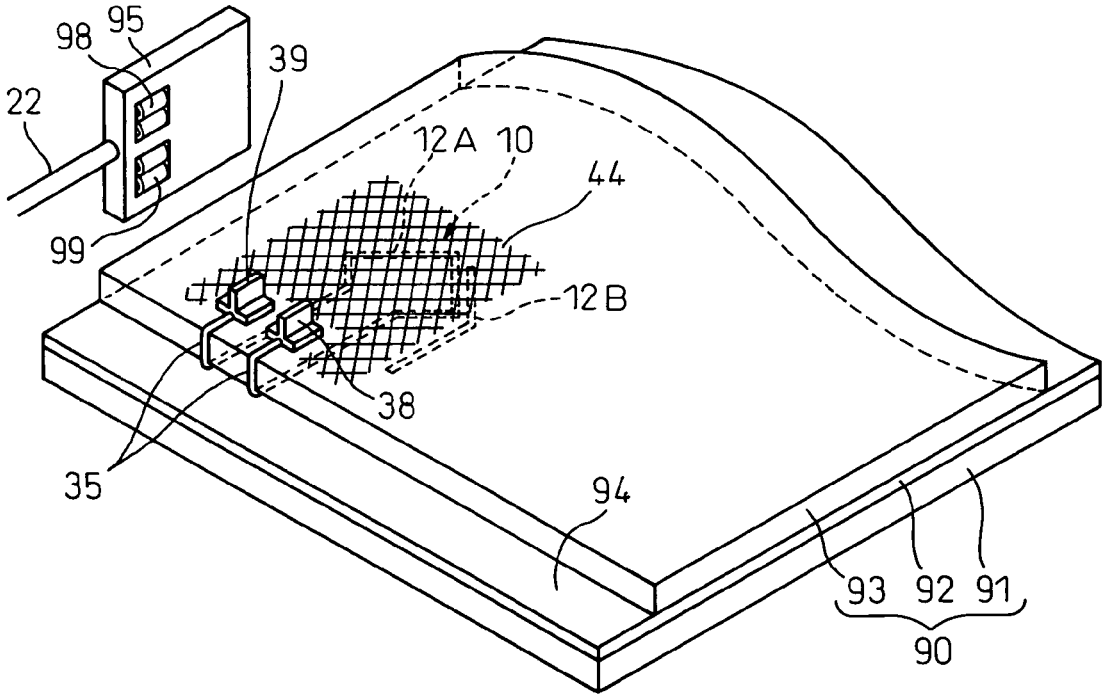
FIG. 12B is a perspective view showing another embodiment of connection with a connector in the case of forming the loop antenna of the present invention in an automobile front windshield.

FIG. 12B shows another embodiment of connection with the connector 95 when forming the loop antenna 10 of the present invention at the front windshield 90 of an automobile. The front windshield 90 of this embodiment is also comprised of a laminate of outside glass 91, a resin sheet 92, and inside glass 93. Its lateral direction ends are formed with step differences 94. The loop antenna 10 of the present invention is embedded in advance in part of the resin layer 92 at the stage of production of the front windshield 90. The two ends of the loop element 12A are led out by wires 35 to a step difference 94 of the front windshield 90. Further, the wires 35 are bent at the step difference 94 to the inside glass 93 side and are connected to connection projections 38, 39 provided at the inside compartment side of the inside glass 93. Further, around the loop antenna 10, as illustrated, the metal mesh wire 44 is provided.

Figure 12C:
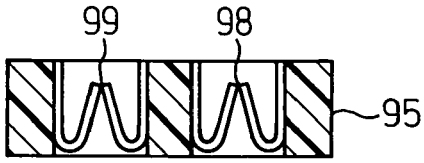
FIG. 12C is a sectional view showing the configuration of the connector of FIG. 12B.

The connector 95 connecting to the connection projections 38, 39 provided at the inside compartment side of the inside glass 93 is provided with a plastic housing provided with connection terminals 98, 99 having springiness. The structure of the connector 95 is the same as the structure shown in FIGS. 13A and 13B except for the structure of the connection terminals 98, 99 having springiness. The connection terminals 98, 99, as shown in FIG. 12C, are both comprised of two springs facing each other. The connection projections 38, 39 are designed to be inserted between these springs while pushing them apart. The connector 95 may be attached to the front windshield 90 by a method the same as in the embodiment of FIG. 13A using two-sided adhesive tape, an adhesive, or other means.

Note that if providing a monopole antenna or another loop antenna adjoining a loop antenna 10 of the embodiment explained with respect to FIG. 12A, 12B as shown in FIG. 10A, an integrated antenna can be formed at the front windshield 90.

Figure 14:
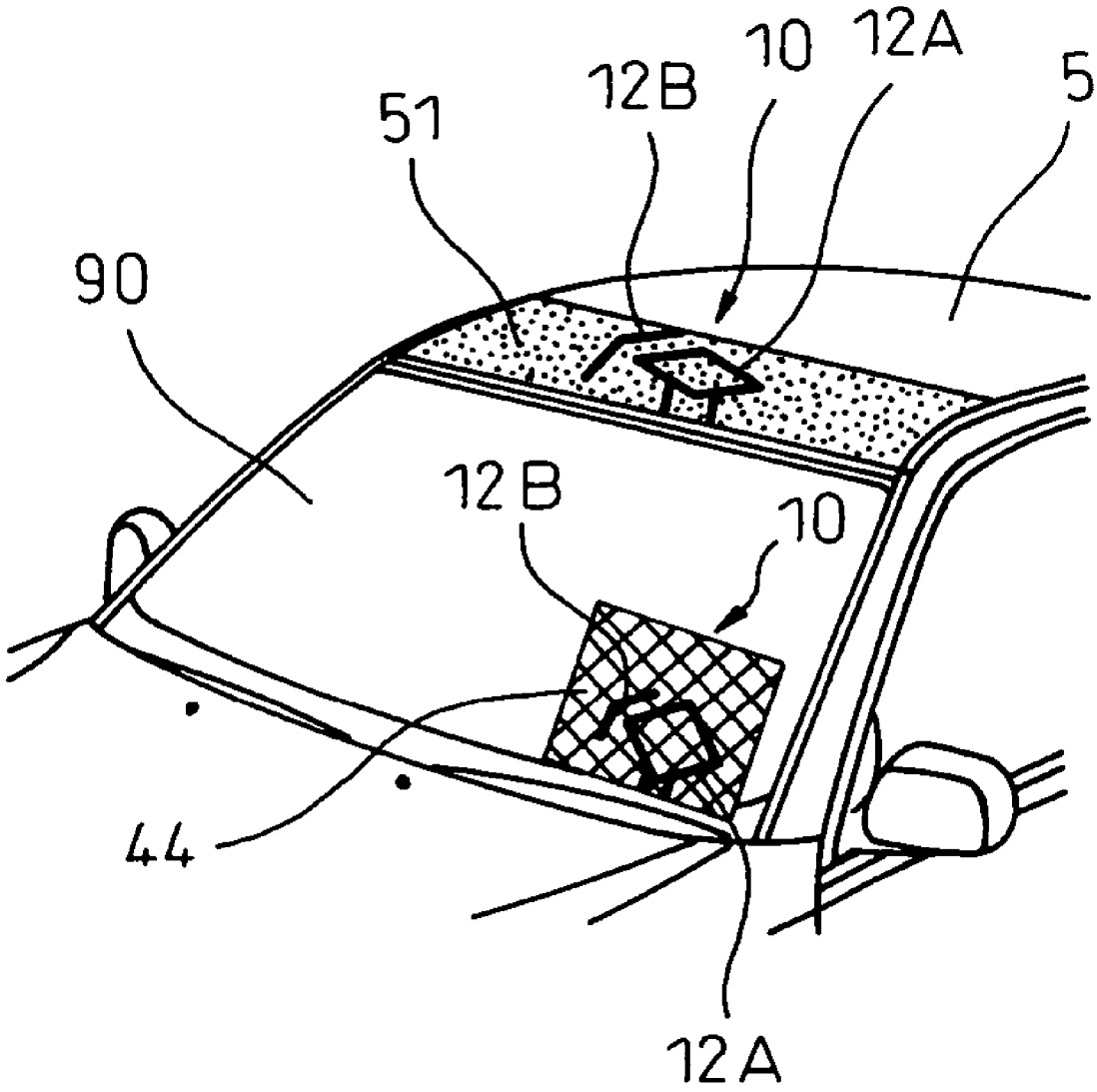
FIG. 14 is a partial perspective view of an automobile showing an embodiment of providing the loop antenna of the present invention at the plastic body of an automobile.

Further, the loop antenna 10 of the present invention, as shown in FIG. 14, may also be attached to a plastic body panel 51 of a vehicle in addition to a dielectric member of the automobile 5 such as glass (front windshield 90).

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. A loop antenna for sending or receiving a circularly polarized wave, provided with:

an antenna element comprised of a loop element formed on a single surface and a parasitic element provided independent of the loop element on the same surface and a conductor surface parallel with or having a slight inclination from said surface provided near said surface, wherein said antenna element is formed on one surface of a dielectric board or at a certain layer of a member forming a dielectric board, while the conductor surface is formed on the other surface of this dielectric board or at another layer than that certain layer of the member forming the dielectric board.

2. A loop antenna as set forth in claim 1, wherein said conductor surface is comprised of wire conductors arranged in a mesh.

3. A loop antenna as set forth in claim 1, wherein said dielectric board is a dielectric member provided in a vehicle.

4. A loop antenna as set forth in claim 1, wherein said antenna element and said conductor surface are provided on different dielectric boards.

5. A loop antenna as set forth in claim 3, wherein said conductor surface is a conductor forming part of the chassis of the vehicle, a conductor forming part of equipment provided in the vehicle, or a conductor attached to the vehicle.

6. A loop antenna as set forth in claim 3, wherein part of the member forming said conductor surface is extended in the direction of the dielectric member forming the antenna element and this extended part used to support the dielectric member.

7. A loop antenna as set forth in claim 1, provided with:

power part formed on a surface separate from the surface where the antenna element is provided, a conducting part connecting the antenna element and said power part, a mesh ground pattern formed on the surface of the dielectric where the power part is provided, and a driven circuit part provided to contact the power part.

8. A loop antenna as set forth in claim 7, wherein said dielectric is a dielectric member forming part of a vehicle.

9. A loop antenna as set forth in claim 1, wherein the distance between said conductor surface and said antenna element is $\lambda/4$ or more.

10. A loop antenna for sending or receiving a circularly polarized wave, provided with:

an antenna element comprised of a loop element formed on a single surface and a parasitic element provided independent of the loop element on the same surface and a conductor surface parallel with or having a slight inclination from said surface provided near said surface, wherein the conductor pattern of the antenna element is formed on said dielectric board, while the same board is formed with a circuit connecting to the loop element of said antenna element.

11. A loop antenna as set forth in claim 10, wherein said circuit is arranged inside the loop of said loop element.

12. A loop antenna as set forth in claim 11, wherein, outside of the circuit, two loop elements with different loop diameters are formed doubly without overlap.

13. A loop antenna for sending or receiving a circularly polarized wave, provided with:

an antenna element comprised of a loop element formed on a single surface and a parasitic element provided independent of the loop element on the same surface and a conductor surface parallel with or having a slight inclination from said surface provided near said surface, wherein said conductor surface is comprised of wire conductors arranged in a mesh, and wherein the wire conductors arranged in the mesh has a pitch of $\lambda/10$.

14. An antenna system comprised of:

a loop antenna having an antenna element comprised of a loop element and a parasitic element provided independently of said loop element on the same surface and sending or receiving a circularly polarized wave, an electronic apparatus processing a signal sent or received by the loop antenna, a cable connecting the loop antenna and said electronic apparatus, and a conductor surface parallel with or having a slight inclination from said loop antenna provided near said loop antennas, wherein said antenna element is formed on one surface of a dielectric board or at a certain layer of a member forming a dielectric board, while the conductor surface is formed on the other surface of this dielectric board or at another layer than that certain layer of the member forming the dielectric board.

15. An antenna system as set forth in claim 14, wherein said conductor surface is a conductor surface provided in said electronic apparatus.

16. A vehicle equipped with an antenna system comprised of a loop antenna having an antenna element comprised of a loop element and a parasitic element provided independently of said loop element on the same surface and sending and receiving a circularly polarized wave, an electronic apparatus for processing a signal sent or received by the loop antenna, a cable connecting the loop antenna and electronic apparatus, and a conductor surface parallel with or having a slight inclination from said loop antenna provided near said loop antenna, wherein said antenna element is formed on one surface of a dielectric board or at a certain layer of a member forming a dielectric board, while the conductor surface is formed on the other surface of this dielectric board or at another layer than that certain layer of the member forming the dielectric board.

* * * * *

UNITED STATES PATENT AND TRADEMARK OFFICE

CERTIFICATE OF CORRECTION

PATENT NO. : 7,408,524 B2
APPLICATION NO. : 11/391756
DATED : August 5, 2008
INVENTOR(S) : Kazushige Ogino It is certified that error appears in the above-identified patent and that said Letters Patent is hereby corrected as shown below:

In the Claims

Column 12, line 21, Claim 14 — Delete "antennas", Insert --antenna--

Signed and Sealed this

Twenty-sixth Day of May, 2009

JOHN DOLL
*Acting Director of the United States Patent and Trademark Office*